United States Patent [19]

Lundberg et al.

[11] Patent Number: 5,066,251

[45] Date of Patent: Nov. 19, 1991

[54] DEVICE CONNECTABLE TO THE REAR COVER OF A CONNECTOR

[75] Inventors: Per-Olof Lundberg, Karlskoga; Sven-Olov Pettersson, Karlstad, both of Sweden

[73] Assignee: Aktiebolaget Bofors, Bofors, Sweden

[21] Appl. No.: 544,889

[22] Filed: Jun. 28, 1990

[30] Foreign Application Priority Data

Jun. 30, 1989 [SE] Sweden ..... 8902371

[51] Int. Cl.[5] ..... H01R 13/514

[52] U.S. Cl. ..... 439/701

[58] Field of Search ..... 439/686, 690, 695, 701, 439/718, 610

[56] References Cited

U.S. PATENT DOCUMENTS

| | | | |
|---|---|---|---|
| 2,764,749 | 9/1956 | Aberle | 439/718 X |
| 3,173,734 | 3/1965 | Hartwell | 439/701 X |
| 4,678,259 | 7/1987 | Petit | 439/610 |
| 4,731,501 | 3/1988 | Clark et al. | 439/718 X |
| 4,861,282 | 8/1989 | Kobayashi et al. | 439/540 |

FOREIGN PATENT DOCUMENTS

| | | | |
|---|---|---|---|
| 0275113 | 7/1988 | European Pat. Off. . | |
| 2429049 | 1/1976 | Fed. Rep. of Germany . | |
| 3000670 | 1/1979 | Fed. Rep. of Germany . | |
| 2558885 | 1/1980 | Fed. Rep. of Germany . | |
| 1474923 | 3/1967 | France | 439/718 |
| 0638409 | 6/1950 | United Kingdom | 439/718 |
| 2181902 | 4/1987 | United Kingdom . | |

*Primary Examiner*—Neil Abrams
*Assistant Examiner*—Khiem Nguyen
*Attorney, Agent, or Firm*—Pollock, Vande Sande & Priddy

[57] ABSTRACT

A connector incorporates an apparatus for facilitating entry and exit of the cable leads of the connector. The apparatus includes a hood-shaped member with a top portion which is provided with one or more socket-shaped transition members for the cable leads. The top portion consists of at least two combinable modular elements. These include one or more plate-like parts, each provided with its transition member, and one or more plate-like parts without transition members. The modular elements are connectable with the aid of tongues and grooves provided in the modular elements and the side portion of the hood-shaped member.

19 Claims, 3 Drawing Sheets

DEVICE CONNECTABLE TO THE REAR COVER OF A CONNECTOR

TECHNICAL FIELD

The present invention relates to a device which is connectable to the rear cover of a connector for facilitating entry and exit of the cable leads of the connector. The device includes a hood-shaped portion with a casing which is provided with one or more socket-shaped transition members for the cable leads. The present invention is applicable for use with multi-way connectors.

BACKGROUND ART

Connectors of the type contemplated here are previously known in this art and, by way of example, mention may be made of the connector manufactured by "Raychem" and marketed under number CHA-0081. Such a connector is provided with a transition member which forms a separate part in relation to the rest of the connector. The transition member is, in a known manner, adapted to be secured to and removed from the rear cover of the connector. The prior art transition member essentially comprises a socket-shaped portion for the transition function and the transition member as such consists of a molded part.

SUMMARY OF THE INVENTION

In connectors of the above type, there is a need for greater utilization of the space available in each respective connector. This is due to steadily increasing demands on packing density in the equipment which is to be electrically connected using the connector(s). The interior space in such a connector is extremely cramped, with numerous connection stubs (to terminal blocks), and soldering and marking sockets.

There are also demands for improved serviceability of such connectors. Fault-tracing functions in ancillary equipment and connectors could also be facilitated.

The above requirements may not be fulfilled by greater complexity in the design and construction of the connector, more rational production, and the like. The electrical tightness of the connector must also be maintainable where necessary.

SUMMARY OF THE INVENTION

The object of the present invention is to propose a device which solves the above and other problems. The novel device according to the present invention includes the casing made of two or more combinable modular elements, which consist of one or more plate-like apertured parts each provided with its own transition member, and of one or more non-apertured plate-like parts functioning as blind washers.

In one preferred embodiment, the modular elements are provided, with corresponding tongues and grooves for allowing simple assembly of the casing. At its region supporting the casing, the hood-shaped portion is also provided with tongues and grooves which fit into corresponding tongues and grooves on the modular elements.

In one preferred embodiment, the hood is divided into a main portion and a lid removably disposed in relation thereto and preferably forming one longitudinal side of the hood when it is attached. The modular element parts are provided with transition means which include socket-shaped transition members of different diameters. Each respective socket-shaped transition member may extend perpendicularly or at an angle to the plane of the casing. The same connector may be provided with a plurality of parts fitted with transition members, each respective transition member being allocated to cable leads whose destinations differ from those of the other cable leads. The modular elements are applied to the body portion and to each other when the lid is removed or moved aside. Thus applied modular elements are thereafter mutually lockable to one another and to the main portion and lid when the lid is in attached or secured position in relation to the main portion. In the event that the transition member on a part provided therewith is of a diameter which exceeds the width of the hood-shaped portion, this part provided with transition member assumes a size which corresponds to the size of two assembled parts functioning as washers. The connectors may be disposed beside one another. In connectors with parts whose diameters exceed the width of the hood-shaped portion, the parts in an adjacent connector must be mutually displaced in the longitudinal direction of each respective hood-shaped part.

The present invention makes it possible to provide a more destination-geared service and fault tracing within each respective connector and its associated equipment. It is now no longer necessary to desolder a common cable transition in all service and fault-tracing cases. Only that cable/destination which is subject to remedial action needs to be removed, while the remaining cable transitions can remain unaffected. As a result of the novel module system according to the invention, the construction and use of the product/connector will be optimized and may be well adapted to each particular physical application. The degree of utilization in each respective connector will be substantially increased. It is also possible to individualize cable routing within and in association with the connector. Hence, for example, it is possible to arrange the connection with small bends on the connecting cable, for example by selecting transition members which are angled in relation to the plane of the casing.

BRIEF DESCRIPTION OF THE ACCOMPANYING DRAWINGS

One preferred embodiment of a device according to the present invention will be described hereinafter with particular reference to the accompanying Drawings, in which.

Figure 6:
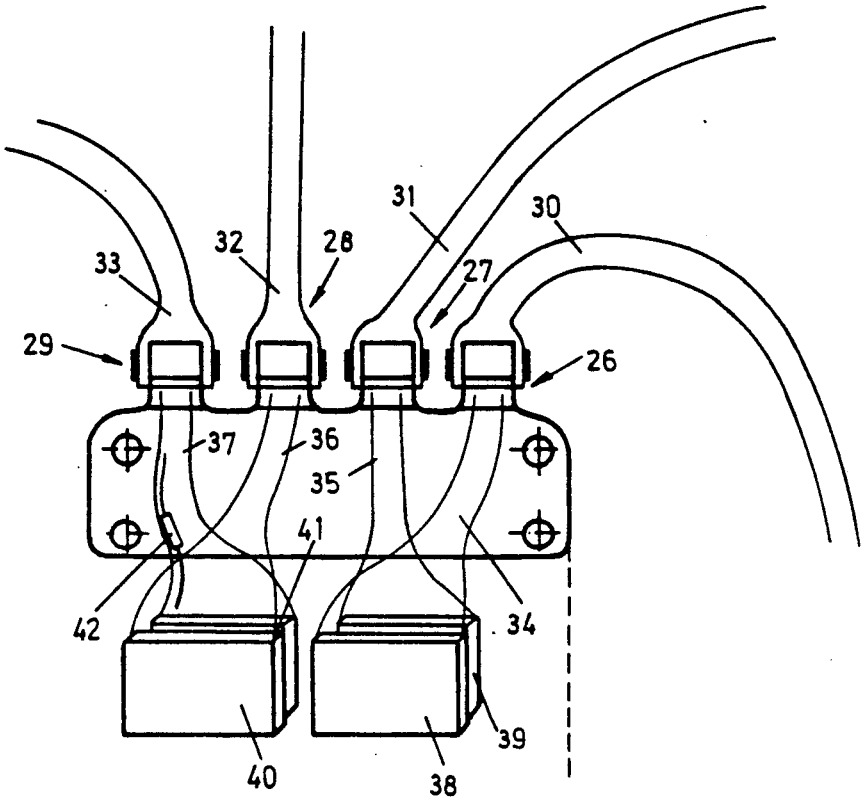
Figure 7:
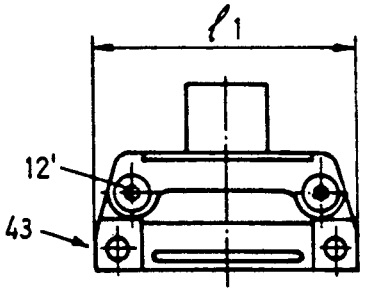
Figure 7A:
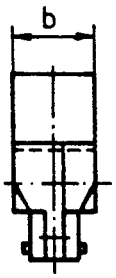
Figure 8:
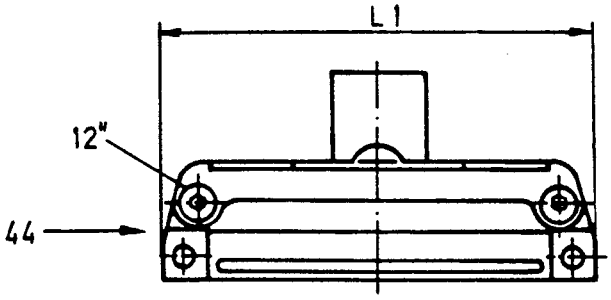
Figure 8A:
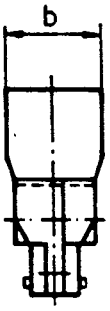

FIG. 6 schematically illustrates connection to different destinations of cables to connectors with a plurality of transition members, FIGS. 7–7*a* are different views of a first embodiment of a connector, and FIGS. 8–8*a* are different views of a second embodiment of a connector.

DESCRIPTION OF PREFERRED EMBODIMENT

Figure 1:
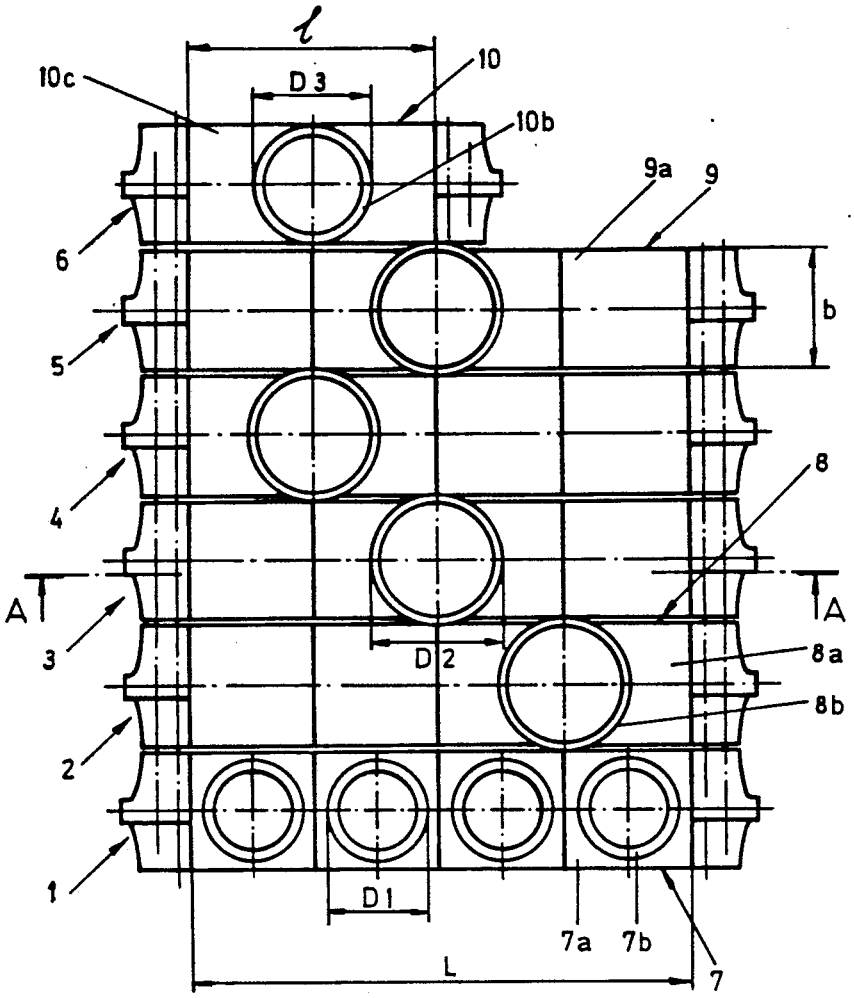
FIG. 1 is a horizontal view of a number of adjacently disposed connectors.

Referring to the Drawings, FIG. 1 shows, in horizontal view from above, connectors numbered 1–6 which are disposed adjacent to and parallel to one another. The connectors are of different construction as regards the part illustrated in FIG. 1. Each respective connector displays a casing composed of different modular elements 7-10. The first modular element 7 includes a washer-shaped (apertured plate-like) portion 7*a* and a protruding transition member 7*b* for a cable. The transition member displays a diameter D1. The second modular element 8 includes a plate-like portion 8*a* and a protruding transition member 8*b* for a cable. The transition member displays a diameter D2 which exceeds the width b of each respective connector. In this embodiment, the connectors are of the same width b. The washer-shaped (plate-like) element 8*a* is of a length which is twice the length of the washer-shaped part 7*a*. The third modular element 9 consists of a non-apertured plate-like member 9*a*. The fourth modular element includes a washer portion 10*a* and a transition member 10*b* with a diameter D3. The washer portion 10*a* displays a length which corresponds to the length of the washer 8*a*. The diameter D3 corresponds to the width of each respective connector.

In this embodiment, each respective connector may be considered as including a casing which consists of four (in respect of connector 1) or two (in respect of connectors 2, 3, 4 and 5) modular elements which together make up a length of L. Connector 6 has a covering plane/casing of a length $l=L/2$ and only one modular element.

The modular elements may be assembled mutually with one another and with a hood-shaped connector portion in accordance with the following disclosure. Such assembling is effectuated with the aid of tongues and grooves in the modular elements and the hood-shaped portion. Several types of modular elements may occur. In connectors located adjacent one another and provided with transition members which are larger than the width of each respective connector, the modular element portions 8*a* are mutually offset in relation to one another in order to ensure efficient utilization of the space occupied by the connectors.

Figure 3:
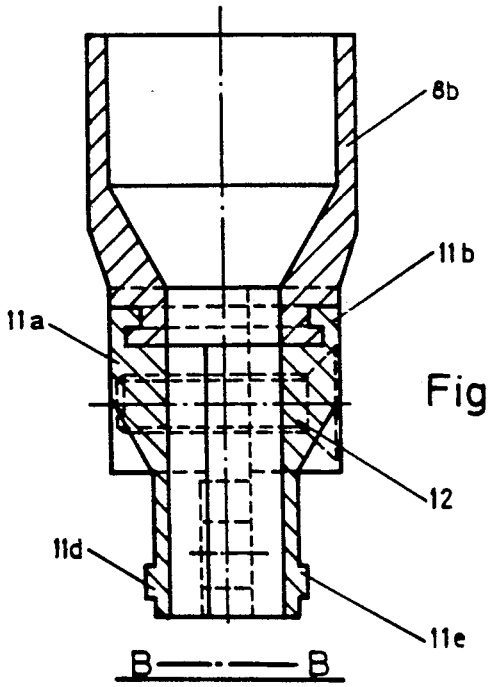
FIG. 3 is a cross-section of a connector.
Figure 2:
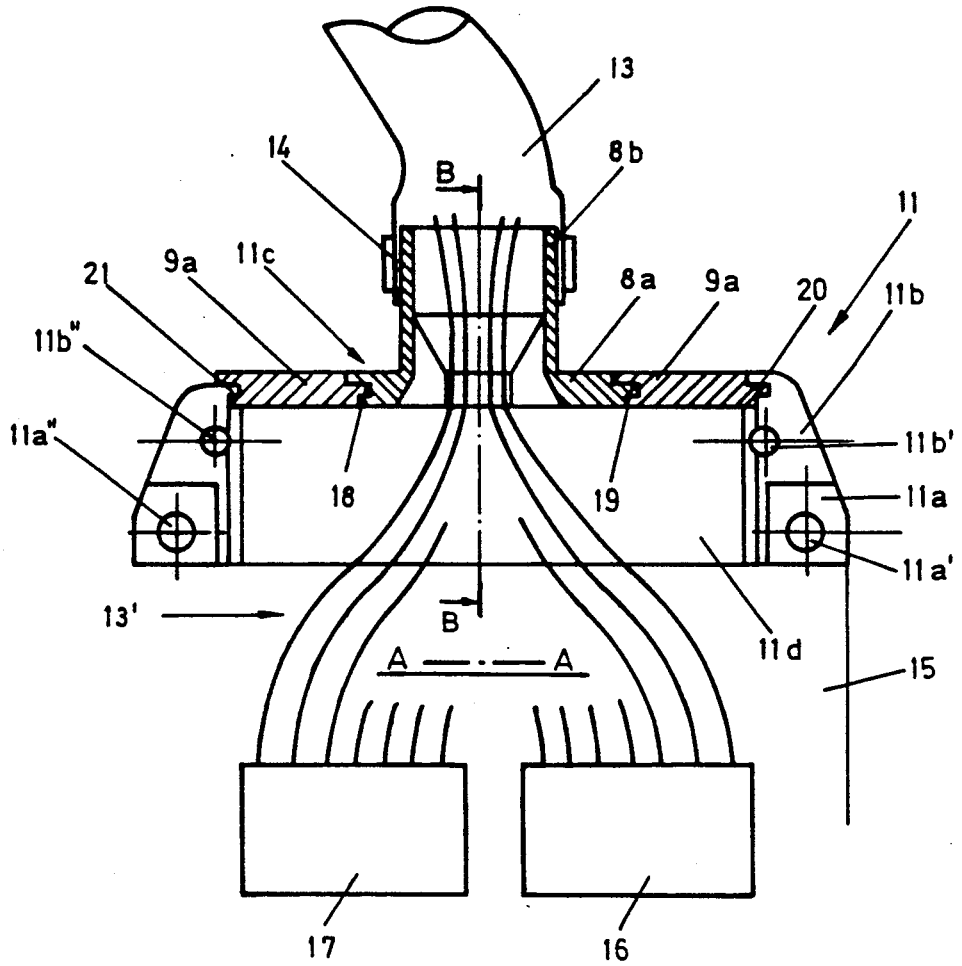
FIG. 2 shows, in longitudinal section, the construction of a connector.

According to FIGS. 2 and 3, each respective connector includes a hood-shaped portion 11 which, in turn, consists of a main body portion 11*a* and a lid 11*b*. The main body portion carries the covering plane/casing 11*c* composed of the modular elements in accordance with the foregoing. Essentially, the lid 11*b* forms one longitudinal side of the hood-shaped portion 11 and is lockable to the body portion 11*a* by means of retainers, for instance in the form of two screws of which one is shown by broken lines in FIG. 3. Assembly of the part 11*a* and the lid 11*b* is effected by means of mutual guides disposed in a known manner in the part and the lid, respectively. A cable 13 is anchored to the socket-shaped transition member 8*b* and the sheath of the cable is secured in a known manner, for instance by means of a clamping ring 14. The leads 13' of the cable are passed through the socket-shaped transition member 8*b* to the interior/inner space 11*d* of the hood-shaped portion 11.

The hood-shaped portion 11 illustrated in FIGS. 2 and 3 consists of a separate transition member which is connectable to a rear cover on a known connector. In the prior-art connector, the transition portion of the connector is thus replaced by the transition member according to the present invention. Connection and securing are accomplished by means of screws, for instance two screws whose holes in the body portion have been indicated by reference numerals 11*a'* and 11*a''*. In FIG. 2, screw holes for the screws 2 of the lid are indicated by reference numerals 11*b'* and 11*b''*. The main body portion and the lid are provided with longitudinal flanges 11*d* which are included in the fixing function to the prior-art rear cover.

The rear cover in the prior-art connector is symbolized in FIG. 2 by reference numeral 15. The prior-art rear cover includes connection terminals/blocks 16, 17 to which the cable leads are led down and connected. Insertion of the cable leads is done with the lid removed.

The modular elements are assembled together with the aid of tongues 18, 19 and 20 in the modular elements and tongues 21 in the lid/main body portion. The tongues are insertable in corresponding grooves in adjacent modular elements/body portions/lids. The modular elements may be connected to the body portion and to one another when the lid is removed and locking of the entire package with modular elements, body portion and lid is achieved when the lid is secured/screwed to the body portion.

Figure 4:
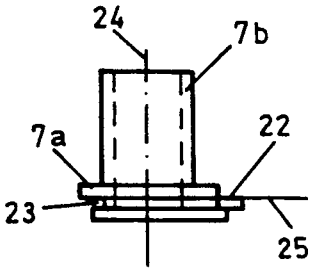
FIG. 4 is a side elevation of one modular element in a first embodiment.

FIG. 4 shows how each respective modular element is designed with the tongue 22 and the groove 23 which thus fit into a corresponding groove and corresponding tongue in an adjacent modular element/body portion/lid. The modular element is insertable in only one direction, namely that direction which coincides with the direction at right angles to the plane of the figure of FIG. 4.

Figure 5:
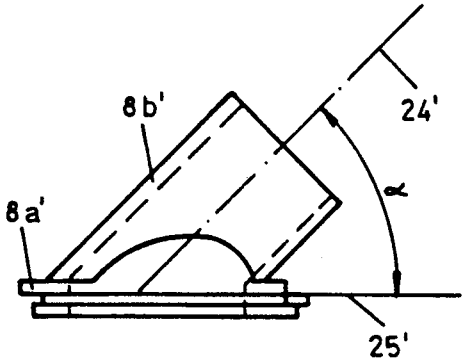
FIG. 5 is a side elevation of a modular element of a second embodiment.

In FIG. 4, the longitudinal axis 24 of the transition member is at right angle to the plane of the casing which, in FIG. 4, is symbolized by reference numeral 25. FIG. 5 illustrates an example of a fifth modular element 8*a'*, 8*b'*, whose longitudinal axis 24' forms an angle $\alpha$ with the plane 25' of the casing. This angle may be different for different modular elements and, in the illustrated embodiment, is approximately 45°. This angular setting facilitates cable routing in associated equipment, since the cable does not need to be bent heavily on connection in those cases when the cable is passed at an angle in towards the connector.

FIG. 6 shows how the transition portion may be built up from a number of transition members, for example four transition members 26–29. Each respective transition member is allocated its cable 30–33 which may be given different destinations. The leads 34–37 are, for instance, allocated each to its terminal block 38–41. Each respective cable and terminal block in the connector may, by such means, be treated separately without intervening in or interferring with other cables/terminal blocks, which is to be compared with prior-art cases when a remedial measure or inspection at any point in the equipment necessitated dismantling the entire connector. Marking and soldering sockets are represented by reference numeral 42.

According to FIGS. 7–8*a*, transition portions 43 and 44 of two different lengths L1 and l1 may be employed. the width b is the same. In each respective embodiment, the screws of the lid are designated 12' and 12''.

The present invention should not be restricted to the embodiment described above and shown on the drawings, many modifications being conceivable without departing from the spirit and scope of the appended claims and the inventive concept as herein disclosed.

What we claim and desire to secure by letters patent is:

1. An apparatus connectable to the rear cover of a connector for facilitating entry and exit of the cable leads of the connector, said apparatus comprising:

a hood-shaped member having a side portion and a top portion, said top portion including at least two exchangeable modular elements including plate-like parts, at least some of said parts being apertured and provided with a transition member for entry of the cable leads, each transition member being adapted for receiving cable leads designated for different terminal blocks of the connector, and locking means provided on said modular members of said top portion and said side portion for interconnecting said modular elements therebetween to form said top portion and for connecting said top portion to said side portion.

2. An apparatus according to claim 1, wherein each transition member includes a socket-shaped member.

3. An apparatus according to claim 1, wherein said modular elements are provided with corresponding tongues and grooves to allow simple assembly of said top portion.

4. An apparatus according to claim 1, wherein said side portion of said hood-shaped member is provided at its region supporting said top portion with tongues and grooves which fit into corresponding tongues and grooves on said modular elements of said top portion.

5. An apparatus according to claim 1, wherein said side portion comprises a main portion and a lid portion, said lid portion being connected to said main portion and forming one longitudinal side of said hood-shaped member.

6. An apparatus according to claim 5, wherein said lid portion for forming said one longitudinal side and said main portion forming remaining sides of said side portion are provided with tongues and grooves.

7. An apparatus according to claim 1, wherein said plate-like members provided with transition members include socket-shaped transition members of different diameters.

8. An apparatus according to claim 2, wherein each respective socket-shaped transition member extends perpendicularly to the plane of the top portion.

9. An apparatus according to claim 2, wherein each respective socket-shaped transition member extends at an angle to the plane of said top portion.

10. An apparatus according to claim 6, wherein said modular elements are connectable to said main portion and to one another when the lid portion forming said one longitudinal side is removed or moved to the side of said hood-shaped member; and wherein said modular elements are mutually lockable to one another and to said main portion and said lid portion when said lid portion is secured to said main portion.

11. An apparatus according to claim 1, wherein said modular elements also include at least one non-apertured plate-like part.

12. An apparatus according to claim 1, wherein transition members having a diameter which exceeds the width of the hood-shaped member are allocated to two assembled plate-like members.

13. An apparatus according to claim 10, wherein a plurality of hood-shaped members are disposed adjacent and parallel to one another; and wherein two hood-shaped members which carry parts provided with transition members having diameters exceeding the width of each respective hood-shaped member are mutually longitudinally offset.

14. An apparatus according to claim 2, wherein said modular elements are provided with corresponding tongues and grooves to allow simple assembly of said top portion.

15. An apparatus according to claim 2, wherein said side portion of said hood-shaped member is provided at its region supporting said top portion with tongues and grooves which fit into corresponding tongues and grooves on said modular elements of said top portion.

16. An apparatus according to claim 5, wherein said plate-like members provided with transition members include socket-shaped transition members of different diameters.

17. An apparatus according to claim 3, wherein each respective socket-shaped transition member extends perpendicularly to the plane of said top portion.

18. An apparatus according to claim 3, wherein each respective socket-shaped transition member extends at an angle to the plane of said top portion.

19. An apparatus according to claim 4, wherein each respective socket-shaped transition member extends at an angle to the plane of said top portion.

* * * * *